US005995881A

United States Patent [19]

Kull

[11] Patent Number: 5,995,881

[45] Date of Patent: Nov. 30, 1999

[54] INTEGRATED CAB SIGNAL RAIL NAVIGATION SYSTEM

[75] Inventor: Robert C. Kull, Olney, Md.

[73] Assignee: Westinghouse Air Brake Company, Wilmerding, Pa.

[21] Appl. No.: 08/898,373

[22] Filed: Jul. 22, 1997

[51] Int. Cl.[6] ..... B61L 27/04

[52] U.S. Cl. ..... 701/20; 246/182 A; 246/182 B

[58] Field of Search ..... 701/19, 20, 207; 303/128, 132; 340/901, 905; 246/167 R, 182 R, 182 B, 182 C, 191, 122 R

[56] References Cited

U.S. PATENT DOCUMENTS

| | | | |
|---|---|---|---|
| 4,735,383 | 4/1988 | Corrie | 246/3 |
| 5,129,605 | 7/1992 | Burns et al. | 246/5 |
| 5,263,670 | 11/1993 | Colbaugh et al. | 246/63 R |
| 5,332,180 | 7/1994 | Peterson et al. | 246/3 |
| 5,364,047 | 11/1994 | Petit et al. | 246/122 R |
| 5,415,369 | 5/1995 | Hungate | 246/167 R |
| 5,452,870 | 9/1995 | Heggestad | 246/182 R |
| 5,533,695 | 7/1996 | Heggestad et al. | 246/62 |
| 5,711,497 | 1/1998 | Andrianos et al. | 246/34 B |
| 5,740,547 | 4/1998 | Kull et al. | 701/19 |

*Primary Examiner*—Michael J. Zanelli

*Attorney, Agent, or Firm*—James Ray & Associates

[57] ABSTRACT

The cab signal and rail navigation systems of a railway locomotive are combined to form a single integrated system capable of acting as an automatic train protection system. The train travels along a railway route equipped with a wayside signaling system that features a multiplicity of wayside signal devices. Each wayside signal device provides to the cab signal system a cab signal inclusive of signal aspect information as to how the train should proceed along a particular segment of the railway route. When the train is traveling on a segment of track from which the cab signal is available, the cab signal system receives the cab signal via the AC track circuit disposed on the rails as the train approaches each wayside signal device. After filtering and decoding the electrical cab signal, the cab signal system communicates the deciphered signal aspect information to the rail navigation system. The rail navigation system determines whether signal aspect information should be available from the particular track segment the train is encountering and thus whether and how the brakes of the train will be operated thereon should the train engineer be required and fail to operate the brakes according to one or more braking profiles calculated by the system. The integrated system operates as an automatic train protection system whether the wayside signaling system provides cab signal coverage continuously or noncontinuously throughout the railway route.

28 Claims, 4 Drawing Sheets

INTEGRATED CAB SIGNAL RAIL NAVIGATION SYSTEM

CROSS-REFERENCE TO RELATED APPLICATIONS

This application is related to a copending U.S. application entitled RAIL VISION SYSTEM, Ser. No. 08/898,648, filed on Jul. 22, 1997. The copending application is assigned to the assignee of the present invention, and its teachings are incorporated into the present document by reference.

FIELD OF THE INVENTION

The present invention generally relates to a system used to enforce braking of a train in compliance with signal aspect information received from the wayside signal devices of a wayside signaling system. More particularly, the present invention relates to an integrated cab signal and rail navigation system that identifies the particular track segment on which the train is currently travelling and operates the brakes in compliance with the wayside signaling system whether the particular segment on which the train is riding is covered by a wayside signal device and whether signal aspect information is actually received therefrom.

BACKGROUND OF THE INVENTION

The following background information is provided to assist the reader to understand the invention described and claimed below. Accordingly, any terms used herein are not intended to be limited to any particular narrow interpretation unless specifically stated otherwise in this document.

A railway operating authority is responsible for conducting rail traffic safely along the railway track routes under its control. A train is typically conducted safely along a railway route through the use of a wayside signaling system. One type of wayside signaling system shown in FIG. 1A features a continuous succession of DC train detection circuits along the entire length of the railway route through which to control a multiplicity of wayside signal devices spaced apart from each other along the route. Each train detection circuit covers a section of track approximately 10,000 feet in length and is electrically isolated from the next detection circuit via an insulated joint situated between each track section. Each train detection circuit merely detects whether its section of track is occupied by a train and communicates a signal indicative of same to its corresponding wayside signal device. For the wayside signaling system shown in FIG. 1A, each wayside signal device typically takes the form of a display of colored lights or other indicia through which to visually communicate signal aspect information to a train operator. It is the signal aspect information that denotes the condition of the upcoming segment of track, i.e., whether it is clear, occupied by a train or subject to some other speed restriction.

Each signal aspect is conveyed by a color or combination of colors and denotes a particular course of action required by the operating authority. The particular colors of red, yellow and green generally denote the same meaning as when used on a standard traffic light. In a four aspect wayside signaling system, for example, the following scheme may be employed: green for clear, yellow and green for approach medium, yellow for approach, and red for restricted/stop. If a train is detected on a section of track, the train detection circuit corresponding thereto informs its corresponding wayside signal device. As the train approaches a track segment over which the wayside signal device has coverage, the railway authority that operates that segment then uses the wayside signal device to communicate visually the appropriate signal aspect to the train operator.

Another type of wayside signaling system shown in FIG. 1B also features the continuous succession of DC train detection circuits along the railway track route. They, too, are used to control the wayside signal devices spaced along the route. Each of the wayside signal devices in this type of signaling system also includes an AC track circuit that accompanies or overlays each DC train detection circuit and serves to supplement its visual display. Each wayside signal device through its AC track circuit communicates over the rails the signal aspect information (i.e., the cab signal) up to a range of approximately 5,000 feet. As a train rides on the rails, the cab signal is sensed by pick up coils mounted in front of the leading axle of the locomotive. The cab signal is filtered, decoded and eventually conveyed to a cab signal device located in the cab of the locomotive. The cab signal device typically includes a display of colored lights to convey visually the signal aspect information to the train operator.

Most railway operating authorities such as Conrail and Union Pacific, for example, use a four aspect system to communicate the condition of the upcoming track segment. Each of the wayside signal devices in such a system typically takes the form of an AC power frequency track circuit from which a carrier frequency typically ranging between 50 to 100 Hertz carries the cab signal in coded format. In this four aspect wayside signaling system, each signal aspect is communicated via electrical pulses in the aforementioned way to the cab signal device using the following preset code rates: 180 pulses per minute for Clear, 120 for Approach Medium, 75 for Approach, and 0 for Restricted/Stop. The latter three aspects each impose a restriction in the speed with which the train may proceed along that segment of railway track.

Railway equipment manufacturers have offered a variety of systems whose objective is to operate the brakes of a train in compliance with such directions issued by the railway operating authorities. These systems typically employ the cab signal devices in conjunction with automatic train protection (ATP) systems. By processing the directions received from the wayside signaling systems according to known principles, such prior art devices and systems are used to derive, and require the train to comport with, braking profiles. These prior art systems typically brake the train automatically when the train operates contrary to the limits imposed by the braking profiles and thus contrary to the wayside signaling system on which the train is riding.

The cab signal device thus typically features an audible warning device and an acknowledgment input. The acknowledgment input allows the train operator to acknowledge the more restrictive signal aspects and thereby prevent a penalty brake application. For example, when the train encounters a segment of track over which one of the speed restrictions is in force and the train is nevertheless permitted to exceed the speed restriction, the cab signal device will activate the audible warning device. If the train operator does not initiate a service brake application so that the train comports with the calculated speed distance braking profile, the cab signal device will automatically impose a penalty brake application to stop the train. The cab signal device typically provides power continuously to a feed circuit to energize, and thus keep closed, an electropneumatic valve. Should the train run afoul of the speed distance braking profile, the cab signal device deenergizes the valve to vent the brake pipe to atmosphere thereby applying the brakes. In newer locomotives equipped with modern brake control systems such as the WABCO EPIC® systems, the cab signal device offers a similar input to the electronic brake control system to provide the same function.

Some cab signal devices also offer overspeed protection as an optional feature. A speed sensing device provides an indication of speed to the cab signal device. The cab signal device automatically shuts down the engine of the locomotive if the speed of the train exceeds a predetermined value.

The territorial coverage of the DC train detection circuits and the wayside signal device AC track circuits is typically not coextensive. Whereas each DC train detection circuit covers a section of track approximately 10,000 feet in length, each wayside signal device through its AC track circuit can typically apply its cab signal on a reliable basis to a range of about 5,000 feet. Consequently, repeater units are often used to fill the gaps so as to provide continuous cab signal coverage between wayside signal devices as shown in FIG. 1B.

The cab signal devices on present day trains are designed to operate on wayside signaling systems that provide continuous coverage over the entire track route. Should a wayside signal device or a repeater unit fail, the cab signal device will interpret the loss of signal aspect information as a stop aspect and automatically impose a penalty brake application. Though the train operator can typically prevent a penalty brake application by acknowledgment or other actions, it is generally not operationally acceptable to routinely require repeated wayside signal "cut-out" and "cut-in" procedures to cover such loss of coverage. Though such wayside signaling systems are widely used on both freight railroads and passenger transit properties, they have not been extensively deployed on the longer freight railroad routes. This is primarily due to cost considerations. It is quite expensive to equip railway track routes with wayside signal devices let alone the necessary repeater units. The need for repeater units alone can often more than double the cost of implementing a wayside signaling system. This increase in cost is due to the need for infrastructure such as acquiring sites at which to install the equipment and providing the foundations, equipment housings and power access at those sites. Many railway routes therefore have the type of wayside signaling system shown in FIG. 1C in which there are gaps in cab signal coverage because repeater units either are not used or only used in certain places.

For heavy freight trains with conventional continuous cab signal devices, it is generally not practical to provide automatic train stop techniques to enforce braking. Several factors such as the braking characteristics, the signal block lengths and grades for any given train and terrain are not known and thus worst case conditions would therefore have to be assumed. This would result in overly restrictive braking curve assumptions for most cases, which would affect train operations too severely to be practical. Consequently, most freight train operators with continuous cab signal devices (e.g., Conrail and Union Pacific Railroads), provide only a warning of the more restrictive signal aspects, with an acknowledgment requirement. The penalty brakes are applied automatically only if the train operator fails to acknowledge the more restrictive signal aspects. The train operator can thus satisfy the acknowledgment requirement, yet still not apply the brakes so as to stop the train before approaching a red signal.

Yet another type of wayside signaling system (not shown) also features the continuous succession of DC train detection circuits along the railway track route. They, too, are used to control the wayside signal devices spaced along the route. In this type of wayside signaling system, however, each of the wayside signal devices controls a track transponder located at a fixed point along the track before each wayside signal device. When a train is detected on a section of track, the train detection circuit corresponding thereto informs its corresponding wayside signal device. The train, however, can only receive the signal aspect information from the transponder as it passes by each fixed point. By using the track transponders to transmit additional encoded data such as the profile of the upcoming track segment and the signal block length, a train equipped with an automatic train protection (ATP) system is able to enforce braking on routes covered by such a wayside signaling system.

The primary disadvantage of transponder based ATP systems is that trains so equipped are required to pass discrete points on the railway track to receive the updated signal aspect information. Some railway authorities have therefore used radio systems to supplement the information received from the track transponders. Other authorities have used fixed transponders only, with updated information transmitted by radio from the wayside signal devices.

Another shortcoming common to all transponder based ATP systems is that they are rather expensive to install and maintain. Maintenance, for example, typically requires replacement of transponders that are damaged. Maintenance may also require a change in the codes or the locations of the transponders as the configuration of the railway track may well be changed over time.

Current automatic train protection systems present significant disadvantages whether used in connection with wayside signaling systems featuring wayside signal devices having AC track circuits or fixed point transponders. For wayside signaling systems featuring wayside signal devices that employ AC track circuits, it is expensive to equip railway routes with repeater units to prevent gaps in coverage from which signal aspect information would be unavailable. Moreover, the cab signal device will interpret such loss of the cab signal as a stop aspect and automatically impose a penalty brake application. For wayside signaling systems featuring wayside signal devices that employ fixed point transponders, a train equipped for travel on such routes is required to pass fixed points to receive the updated signal aspect and guidance information from the transponders. Transponder systems are also expensive to install and maintain.

There is therefore a need in the railroad industry for a system that could operate the brakes of a train in compliance with a wayside signaling system without the aforementioned disadvantages. Specifically, it would be quite desirable to develop a system not dependent on fixed point transponders to receive information from the wayside signaling system. Moreover, it would be preferred if such a system would not require the installation of expensive repeater units to fill gaps in cab signal coverage between wayside signal devices. Such a system should be able to operate the brakes in compliance with a wayside signaling system even if the system encounters track segments (i.e., gaps) from which signal aspect information/cab signal is unavailable. Such a system would ideally be designed to operate on either or both of the wayside signaling systems shown in FIGS. 1B and 1C.

Related to the invention is subject matter described and claimed in U.S. Pat. No. 5,740,547 entitled Rail Navigation System, This patent is assigned to the assignee of the present invention, and its teachings are incorporated into the present document by reference. The rail navigation system allows a train to locate the position it occupies on a railway track route.

As best described in the cited document, the rail navigation system features a database including data pertaining to the locations of railway track routes and the locations and orientations of curves and switches in those railway track routes. It also receives inputs from devices such as an odometer, a rate of turn measuring apparatus and a navigational receiver. According to instructions contained within its programming code, the rail navigation system uses the aforementioned data along with and in comparison to the enumerated inputs to determine where the train is located in relation to track route location data stored in the on-board database. Through such processing, the coordinates the train occupies on the globe is matched against the database information to determine not only on which track the train is traveling but also the particular position that the train occupies on that track.

OBJECTIVES OF THE INVENTION

It is, therefore, a primary objective of the invention to determine whether a cab signal should be available from the particular track segment the train is approaching and thus whether and how the brakes of the train will be operated thereon should the train engineer be required and fail to operate the brakes according to a braking profile calculated by the system.

Another objective is to generate braking profiles that are accommodative of changes in various train parameters, signal block lengths and signal aspect information.

Yet another objective of the invention is to assure that the brakes of the train are operated in compliance with the wayside signaling system whether the particular segment that the train is currently encountering is covered by a wayside signal device and whether signal aspect information is actually received therefrom.

Still another objective is to develop an integrated cab signal and rail navigation system that can be used with a wayside signaling system whose cab signal coverage does not extend throughout the entire railway route.

Even another objective of the invention is to develop an integrated cab signal and rail navigation system that can be used with a wayside signaling system without the need to modify (e.g., install repeaters in) the wayside signaling system.

A further objective is to provide an automatic train protection system that can be implemented on nearly all types of trains with minimum affect on current train handling practices and operations.

Yet a further objective is to design an integrated cab signal and rail navigation system that can be implemented with cab signal devices currently used by railway operating authorities.

Still a further objective of the invention is to implement an integrated cab signal and rail navigation system at lower cost than alternative radio based "Positive Train Separation" and "Advanced Train Control" systems currently being considered or developed by other manufacturers.

Even a further objective is to develop an integrated cab signal and rail navigation system that is of particular value to freight railroads which already have a great number of locomotives and great stretches of track equipped with conventional wayside signaling systems.

In addition to the objectives and advantages listed above, various other objectives and advantages of the invention will become more readily apparent to persons skilled in the relevant art from a reading of the detailed description section of this document. The other objectives and advantages will become particularly apparent when the detailed description is considered along with the attached drawings and with the appended claims.

SUMMARY OF THE INVENTION

In a first presently preferred embodiment of the invention, the cab signal and rail navigation systems of a railway locomotive are combined to form an integrated system capable of acting as an automatic train protection system. The train travels along a railway track featuring a wayside signaling system through which a railway operating authority communicates from each wayside signal device in the wayside signaling system signal aspect information as to how the train should proceed along a particular segment of the railway track. The cab signal system receives the cab signal as the train approaches each wayside signal device and communicates the signal aspect information therein to the rail navigation system. The cab signal system also communicates to the rail navigation system via a penalty brake control line whether a penalty brake application is needed. The rail navigation system imposes a penalty brake application based on factors including the estimated distance for braking and specific block lengths relative to the current location and speed of the train. The rail navigation system assures that the brakes of the train are operated in compliance with the wayside signaling system whether the particular segment that the train is currently encountering is covered by a wayside signal device and whether the cab signal is actually received therefrom.

In a second presently preferred embodiment, the present invention provides an integrated cab signal and rail navigation system for a train. The integrated system includes a cab signal system and a rail navigation system. The cab signal system receives the cab signal as the train approaches each wayside signal device and communicates the signal aspect information therein to the rail navigation system. The rail navigation system determines whether signal aspect information should be available from the particular track segment the train is encountering and thus whether and how the brakes of the train will be operated thereon should the train engineer be required and fail to operate the brakes according to one or more braking profiles calculated by the system.

DETAILED DESCRIPTION OF THE INVENTION

Figure 1A:
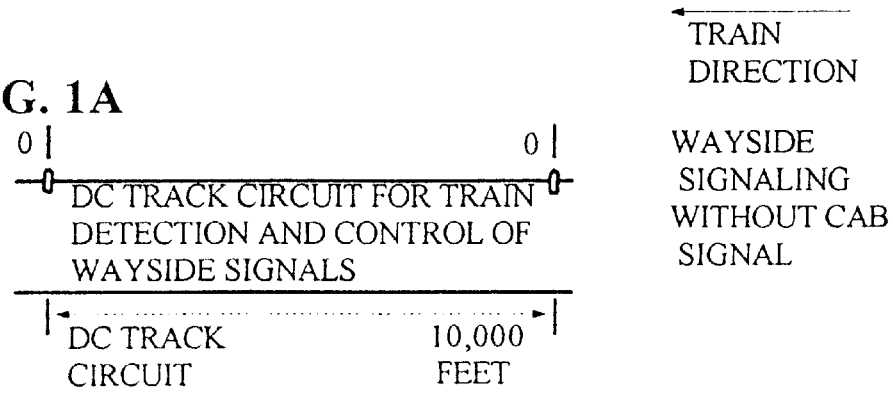
FIG. 1A (Prior Art)
FIG. 1A partially illustrates a typical wayside signaling system that features DC train detection circuits used to control the wayside signal devices through which to visually communicate signal aspect information to a train operator.
Figure 1B:
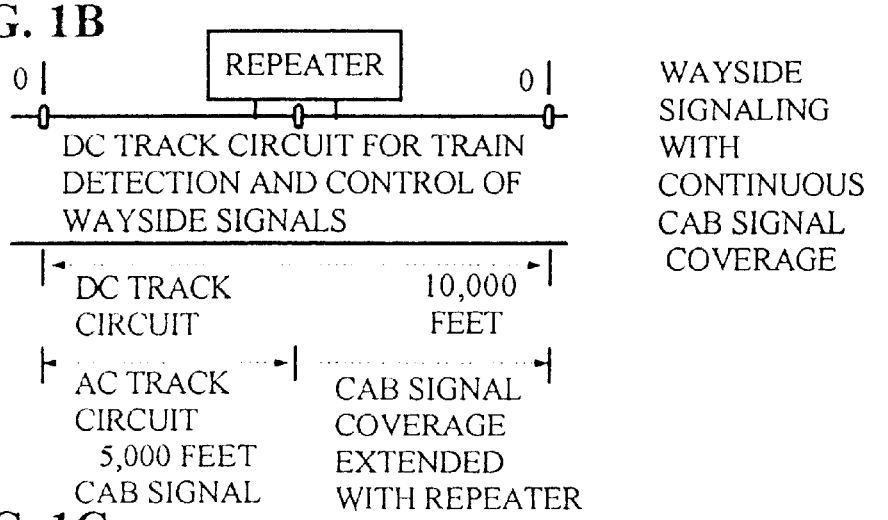
FIG. 1B (Prior Art)
FIG. 1B partially illustrates a typical wayside signaling system that features DC train detection circuits and wayside signal devices supplemented with repeater units through which to provide a cab signal to a locomotive of a train no matter where the train travels along a railway route so equipped.
Figure 1C:
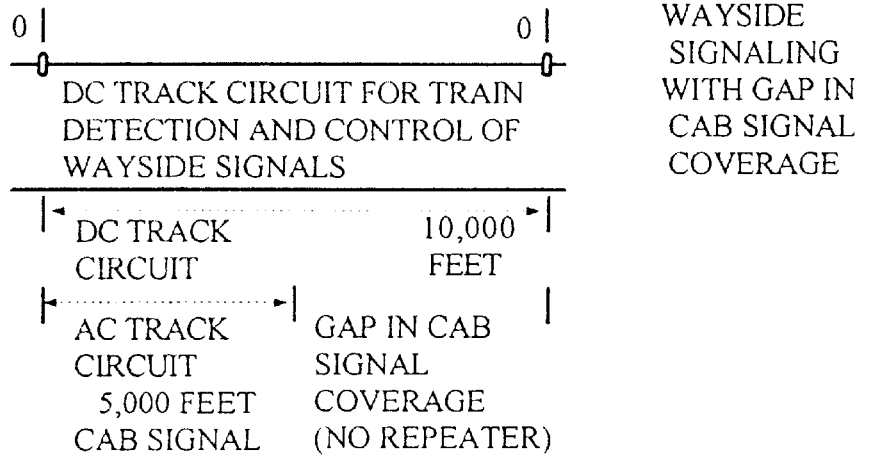
FIG. 1C (Prior Art)
FIG. 1C illustrates the type of wayside signaling system shown in FIG. 1B less the repeater units so that a train travelling on a railway route so equipped will encounter certain segments of track from which a cab signal will not be available.

Before describing the invention in detail, the reader is advised that, for the sake of clarity and understanding, identical components having identical functions in each of the accompanying drawings have been marked where possible with the same reference numerals in each of the Figures provided in this document.

Figure 2:
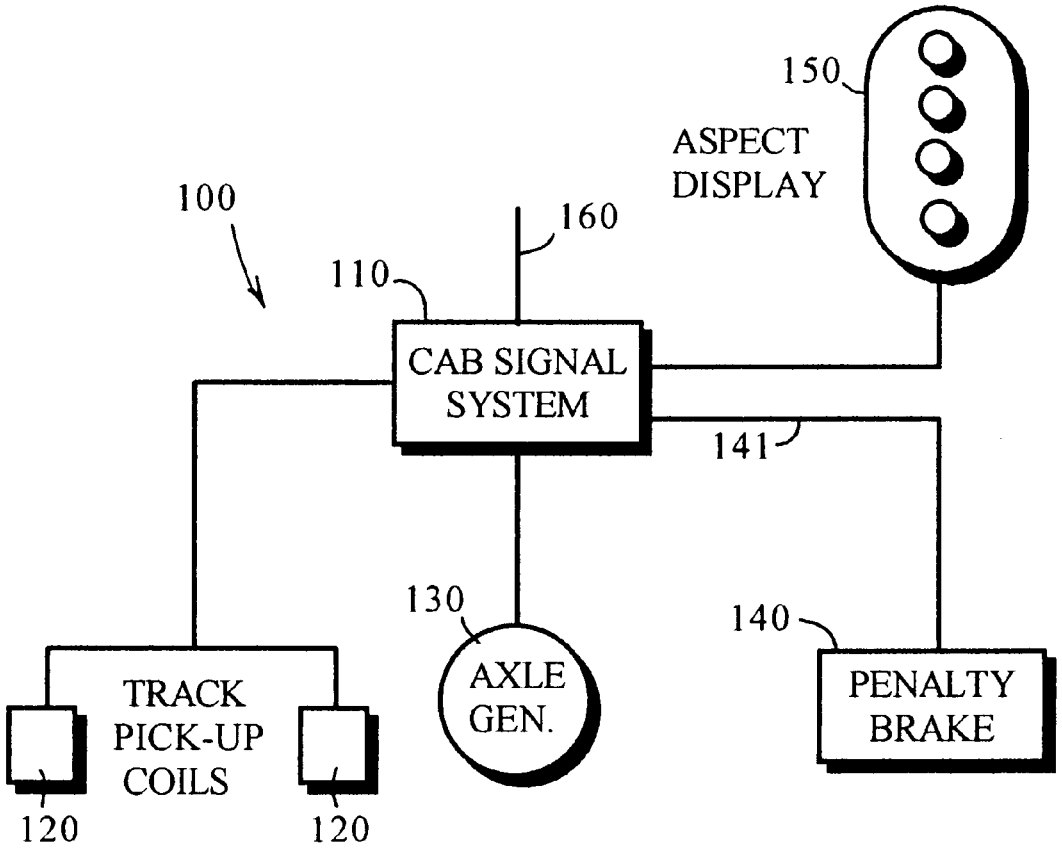
FIG. 2 PRIOR ART
FIG. 2 is a schematic diagram illustrating a prior art cab signal system in block form.

FIG. 2 of the drawings illustrates a typical cab signal system 100 of a type well known in the cab signaling art. The cab signal system generally contains a cab signal device 110, pick up coils 120, a speed sensing device 130, a penalty brake feed circuit 140, a signal aspect display 150 and an acknowledgment input device 160. The cab signal device 110 also includes filtering circuitry and decoding circuitry.

Expanding on the information provided in the background section, the cab signal system 100 operates basically as follows. As a train rides on track segment from which it can receive signal aspect information from a wayside signal device, the pick up coils 120 sense the electrical signals conveyed along the AC track circuit. The filtering circuitry is used to filter out extraneous noise sensed by the pick up coils 120. Such circuitry makes sure that the electrical signals exhibit a frequency within a preset frequency band (e.g., 50 to 100 Hz), a magnitude above a prespecified level and a coding rate within predefined tolerances. The decoding circuitry then decodes the electrical cab signal for the signal aspect information it contains. For the four aspect wayside signaling system alluded to previously, the signal aspect information may be 180 pulses per minute to indicate the Clear Aspect, 120 to indicate Approach Medium, 75 for Approach, or 0 for the Restricted/Stop Aspect. Once decoded, the cab signal device 110 conveys the prevailing signal aspect to the aspect display 150 from which it is displayed to the train operator. As noted in the background section, the prior art cab signal system 100 executes its automatic train protection function through which it can impose a penalty brake application via penalty brake feed circuit 140 if the train operator fails to acknowledge the more restrictive signal aspects via the acknowledge input 160. The penalty brake control line 141 is the route through which the cab signal device 100 controls the penalty brake feed circuit 140.

Figure 3:
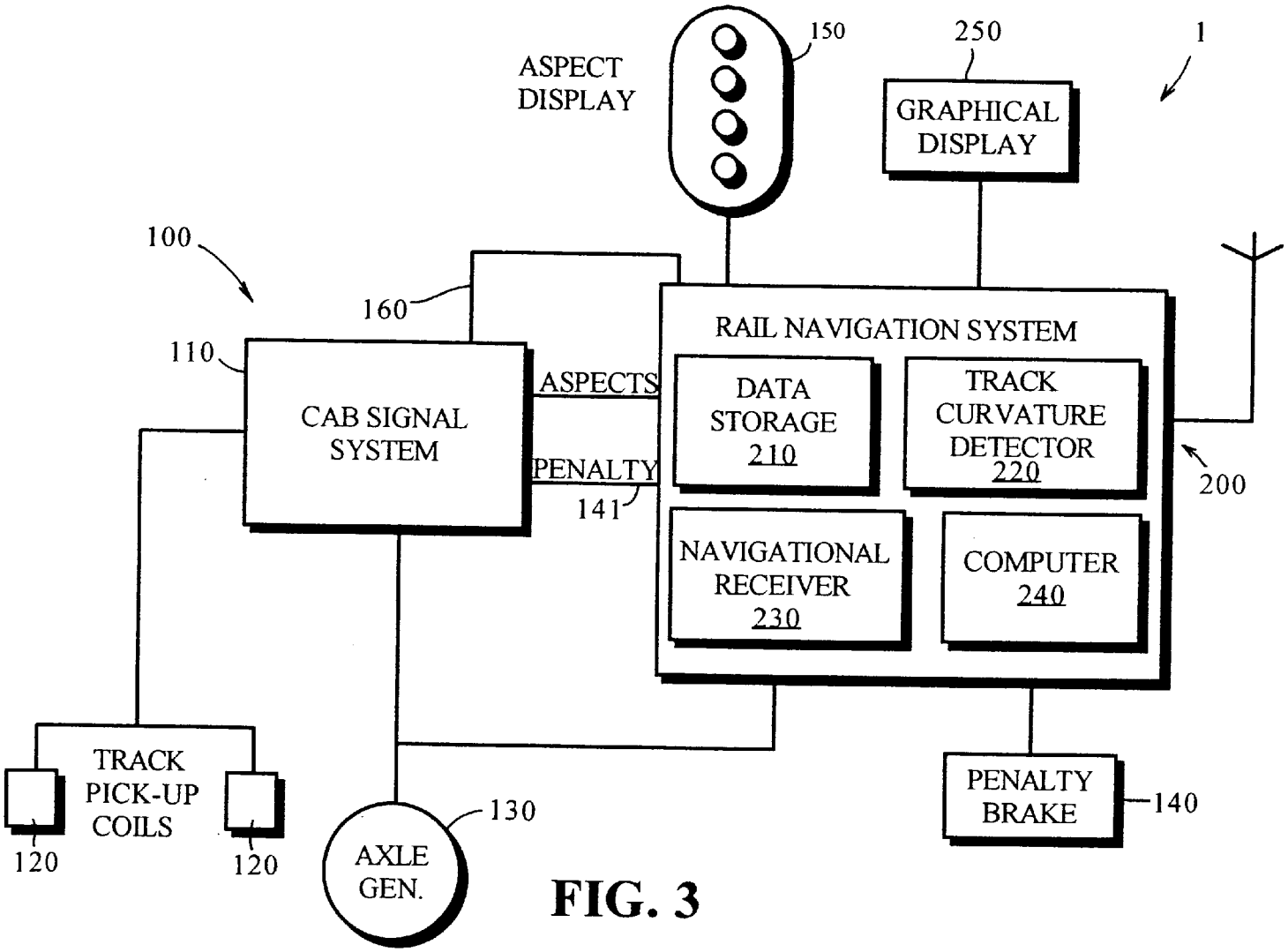
FIG. 3 is a schematic diagram illustrating a first presently preferred embodiment of the invention in block form in which the cab signal and rail navigation systems of a railway locomotive are combined to form an integrated system.

Referring now to a presently preferred first embodiment of the invention, FIG. 3 illustrates an integrated cab signal and rail navigation system 1 that can be implemented using a preexisting cab signal system such as the one shown in FIG. 2. In its most basic form, the integrated system 1 includes a cab signal system 100 and a rail navigation system 200. The cab signal system 100 receives the cab signal from each wayside signal device as the train travels along the railway route. Connected to the cab signal system 100, the rail navigation system 200 enables the brakes of the train to operate in compliance with the wayside signaling system whether the particular track segment that the train is currently approaching is covered by one of the wayside signal devices and whether the system receives or fails to receive the cab signal from that particular track segment.

The rail navigation system 200 includes a storage device, a speed sensing device, a rate of turn measuring apparatus, a navigational receiver and a computer. The storage device 210 is primarily used to store a database composed of a variety of information. As recited in the aforementioned document bearing U.S. Ser. No. 08/604,032, the database includes data pertaining to (i) the locations of railway track routes and (ii) the locations and orientations of curves and switches in those railway track routes. New to the present invention, however, the database also features data pertaining to the location of every segment of all relevant railway track routes whether or not covered by a wayside signal device. Therefore, in the database, each track segment of these railway track routes is preferably assigned one of three reception codes: (1) an unsignaled segment, (2) an intermediary segment and (3) a signaled segment.

An unsignaled segment refers to the type of track segment from which signal aspect information will not be available, i.e., the track segment is not covered by a wayside signal device. This type of segment will typically be encountered after the train has passed a signaled segment. Though no signal aspect information will be received, it is preferred that the integrated system 1 will act as if it had received a signal aspect that is one level more restrictive than that received from the last wayside signal device the train passed. For example, if the train received a clear aspect from the last wayside signal device it passed, the integrated system 1 will act as if it has received an approach medium aspect from the unsignaled segment that it has just encountered. Extending this preferred logic to its conclusion, this would usually indicate to the integrated system 1 that the train will encounter a stop segment two segments ahead.

An intermediary segment refers to the type of track segment from which signal aspect information should be available only under good track conditions. Bad conditions such as rain, snow or other known factors may impede transmission of the electrical signals along the track thereby rendering a section of track incapable of conveying viable signal aspect information. A train will typically encounter an intermediary segment after having passed one or more unsignaled segments. Should the train encounter an intermediary segment from which it receives signal aspect information, the integrated system 1, as explained subsequently, will act according to the signal aspect it has received.

A signaled segment refers to the type of track segment from which signal aspect information should be available. When a train encounters a signaled segment from which it receives a cab signal, the integrated system 1, as explained subsequently, will act according to the signal aspect it has received. Should the train encounter a signaled segment from which it does not receive signal aspect information, however, the train may be restricted as to how it can operate along that segment. For example, failure to receive the cab signal from a signaled segment could be construed as having received a stop aspect. Alternatively, such failure could be construed as having received a signal aspect that is one level more restrictive than that received from the last wayside signal device passed. Exactly how the integrated system 1 will react to such failure will, of course, depend on the operating practices of the railroad.

The speed sensing device of the rail navigation system 200 may be different than or the same as that used by the preexisting cab signal system 100. As shown in FIG. 3, however, the speed sensing device is preferably shared by the cab signal system 100 and rail navigation system 200. Notwithstanding the benefits of sharing, the speed sensing device can take the form of an axle generator, a traction motor speed sensor or other type of known device. Speed sensing device 130 senses the rotation of one of the axles of the locomotive of the train through which it generates a first signal from which the speed of the train can be determined. Alternatively, speed sensing device 130 can be used as an odometer to determine the distance that the train has traveled over time. The signal from an odometer, of course, could be differentiated in time to ascertain the speed of the train.

The rate of turn measuring apparatus 220 and the navigational receiver 230 are best described in the aforementioned document bearing U.S. Ser. No. 08/604,032. The rate of turn measuring apparatus 220 measures the rate at which the train turns while traveling on curves in the railway track. It may take the form of a gyroscope through which to generate a second signal from which curvature of the railway track can be determined. The navigational receiver 230 is used to determine the position that the train occupies on the globe. It is preferred that the navigational receiver 230 take the form of a GPS receiver which can receive global coordinates, such as latitude and longitude, from earth orbiting satellites. The GPS receiver may also be used to provide heading information. Though the GPS receiver should be accurate enough to identify a curve or a switch on which the train is located, it is anticipated, however, that it will not be accurate enough to determine on which set of adjacent, parallel tracks the train may be located. Thus the data that the GPS receiver itself may provide may only be an approximation of the exact location that the train occupies on the globe. It is this navigational receiver 230 that generates a third signal indicative of the approximate position of the train about the railway track.

The computer of the rail navigation system 200 is also best described in the aforementioned document bearing U.S. Ser. No. 08/604,032. According to instructions contained within its programming code, the computer 240 uses the aforementioned data along with and in comparison to the enumerated signals to determine where the train is located in relation to the track route location data stored in the on-board database. Through such processing, the coordinates the train occupies on the globe is matched against the database information to determine not only on which track the train is traveling but also the particular segment and position that the train occupies on that track. Having accurately pinpointed the position of the train, the computer 240 then determines whether and how the brakes of the train will be operated should the train operator be required and fail to operate the brakes according to one or more braking profiles calculated by the computer.

The computer 240 continuously updates the braking profiles based on a variety of parameters including the aforementioned data, the enumerated signals, and the signal aspect information obtained from the last track segment from which such information was available. The process through which the braking profiles are calculated is, of course, well known in the train braking art. Typically two sets of braking profiles will be computed, one for full service braking and the other for emergency braking. Each braking profile will be calculated as a speed distance curve from a target stopping point.

The braking profiles will be used to fully enforce the wayside signaling system in a manner least disruptive to train handling and normal operations. According to the type of track segment the train has encountered, the last signal aspect information received will be used to determine the extent of the current operating authority for the train. Using the current position of the train and the desired point at which the train should be stopped or slowed to a given speed, the computer 240 continuously calculates two speed-distance braking profiles. Using the desired rate for full service braking, the service braking profile is derived so that a full service brake application would be able to stop or slow the train over the distance between the current position of the train and the desired point. Using the desired rate for emergency braking, the emergency braking profile is derived so that an emergency brake application would be able to stop the train in the distance between the current position of the train and the desired point.

The penalty brake control line 141 from the cab signal system 100 is routed to the rail navigation system 200. The rail navigation system 200 thus controls penalty braking based upon calculated braking distances and specific block lengths relative to the current location and speed of the train. Specifically, the computer 240 controls a means for imposing a penalty brake application should the train run afoul of the speed distance braking profiles. The means for imposing the penalty braking application can take the form of any one of a wide variety of known devices as illustrated by the block identified by numeral 140 in FIG. 3. The penalty feed circuit 140 can be used to energize, and thus keep closed, an electropneumatic valve that if opened would vent the brake pipe to atmosphere and apply the brakes. The penalty feed circuit 140 may also be used as an input to a modern brake control system through which to provide the same function. For example, should the speed of the train approach too close to the service brake curve, the train operator would be warned via an audible warning device. If the train operator does not initiate a brake application so that the train comports with the service braking profile, the computer 240 will automatically deenergize the penalty feed circuit 140 to impose a penalty brake application to stop the train. Similarly, if the speed of the train should approach too close to the emergency brake curve, the train operator could again be warned via an audible warning device. If the train operator does not apply the brakes so that the train comports with the emergency braking profile, the computer 240 will automatically impose a penalty brake application to stop the train. For the service braking profile, the penalty brake application would normally be imposed at a full service rate. For the emergency braking profile, it could be imposed at an emergency rate.

The integrated system 1 derives these braking profiles using the data provided by the rail navigation system 200 such as the location and configuration of the track. The integrated system 1 thus operates as an automatic train protection system that is able to enforce braking on routes covered by a wayside signaling system whether or not the wayside signaling system has gaps in cab signal coverage. By using the rail navigation system 200 to generate train specific braking profiles for the specific terrain and track over which the train is travelling, the integrated system 1 compensates for the shorter distance up to which the train is allowed to come to the upcoming wayside signal devices. By constantly monitoring the position of the train, the computer 240 is better able to operate the train according to the braking profile derived for any given section of track. Integrating cab signal with the principles of rail navigation also allows one to fully enforce braking on heavy freight trains on long routes.

The integrated system 1 may also include an acknowledgment input 160 that is controlled by the rail navigation system 200. The acknowledgment input 160 could preferably be used to silence the audible warning devices that would be generated following a failure to respond to the more restrictive signal aspects. The automatic train protection function of the invention, however, obviates the conventional prior art uses of the acknowledgment input (i.e., preventing a penalty brake application).

The integrated system also includes the traditional aspect display 150. Depending on which option is preferred, the rail navigation system 210 may operate the aspect display 150 in any one of two ways. The rail navigation system 210 may illuminate the aspect indicators only when the cab signal is actually received during approach to a wayside signal device. Consequently, the aspect indicators would not be illuminated as the train passes through those track segments that are not covered by wayside signal devices. Alternatively, the rail navigation system 210 may operate the aspect display so that it always displays some indication whether or not the train is travelling on a track segment covered by a wayside signal device. Specifically, the aspect indicators would be illuminated to indicate the prevailing signal aspect as the train passes through those track segments that are covered by wayside signal devices. When passing through track segments not covered by a wayside signal device, however, aspect display 150 could be illuminated to indicate a signal aspect that is one level more restrictive than that received from last wayside signal device passed.

An optional feature of the integrated system 1 could be a graphical display unit 250. This display unit could be used to provide the train operator with supplemental information such as the profile of the upcoming portion of railway track, the estimated distance required to brake the train and the territorial coverage of the railway operating authority. The graphical display unit 250 could also be used in lieu of the conventional cab display unit.

Another optional feature of the invention could be to incorporate overspeed protection into the rail navigation system 200. Formerly performed by the preexisting cab signal system 100, this function is preferably moved to the rail navigation system 200. The first signal output from the speed sensing device 130 generally takes the form of pulses at a frequency proportional to the rate at which the axle rotates. Using the first signal from the speed sensing device 130, the rail navigation system 200 could be used to shutdown automatically the engine of the locomotive should the speed of the train exceed a predetermined value.

Considering the functions performed by the rail navigation system 200, it should be apparent that the cab signal system 100 mostly serves to pick up, filter and decode the cab signal received from the wayside signal devices. The cab signal system therefore includes a means for picking-up the electrical signals from the railway track, a means for filtering out extraneous noise from the electrical signals and a means for decoding the aspect information contained in the cab signals. In a manner well known in the relevant art, the means for filtering conveys the electrical signals to the means for decoding when the electrical signals exhibit a frequency within a preset frequency band, a magnitude above a prespecified level and a coding rate within predefined tolerances. The rail navigation system 200, however, assumes generally all of the other functions previously performed by the cab signal system 100. This includes all functions related to the underlying logic, the display of aspect information and the interfacing with the locomotive.

Figure 4:
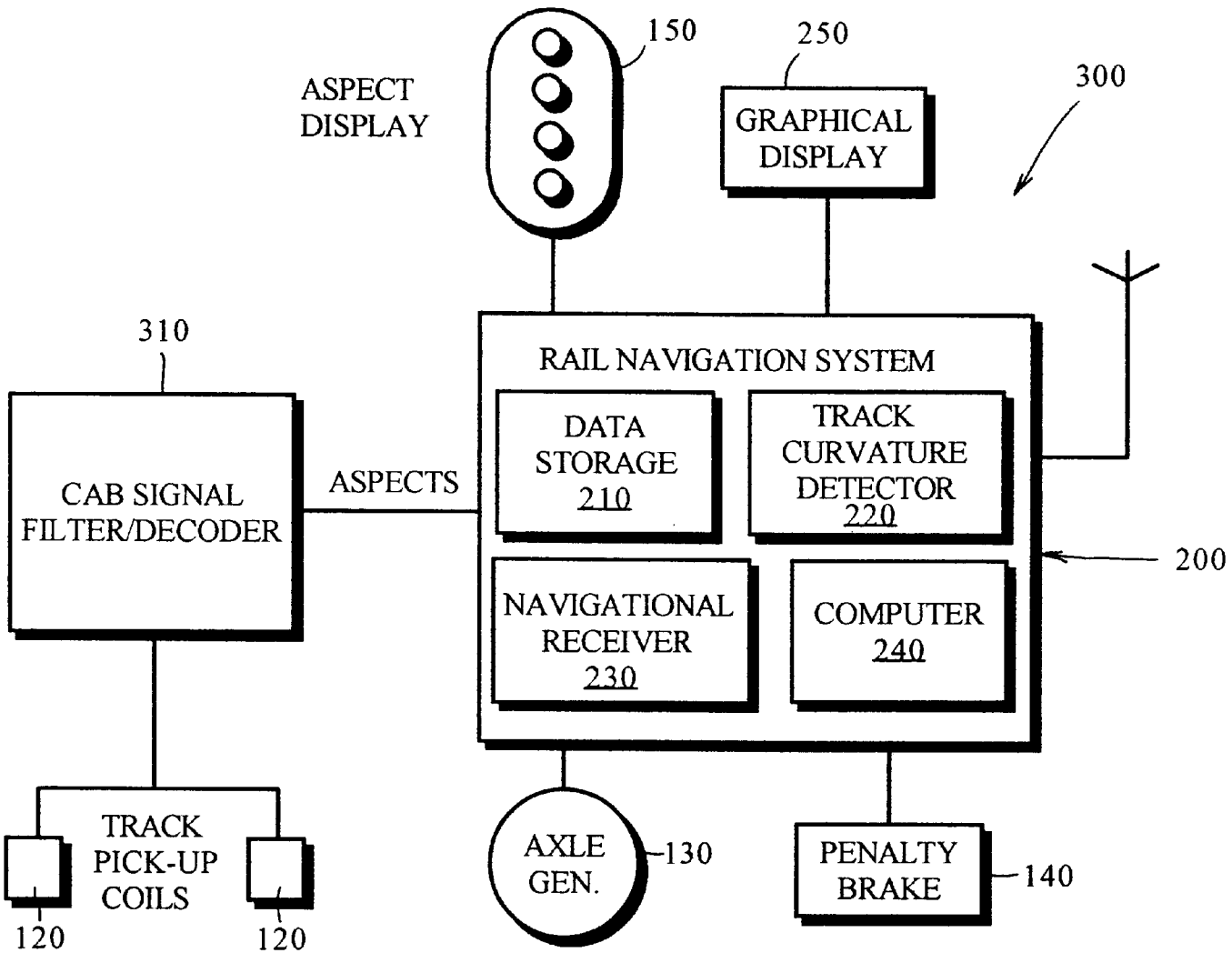
FIG. 4 is a schematic diagram illustrating a second presently preferred embodiment of an integrated cab signal and rail navigation system in block form.

Referring now to a presently preferred second embodiment of the invention, FIG. 4 illustrates an integrated cab signal and rail navigation system that can be implemented as a new, fully integrated system 300. The invention in this embodiment is primarily intended to be installed on locomotives in which cab signal equipment is either not installed or will be replaced.

The integrated system 300 includes a cab signal filter/decoder device 310 and the rail navigation system 200 which together work in generally the same way as the system depicted in FIG. 3. Also referred to as a cab signal system, the filter/decoder device 310 is a simplified version of the cab signal system 100 used with the first embodiment of the invention shown in FIG. 3. The cab signal system 310 in this embodiment merely serves to pick up, filter and decode the signal aspect information received from the wayside signal devices. It need not perform any functions related to penalty braking or overspeed protection as these functions are now performed solely by the rail navigation system 200.

It should be noted that the aspect display 150 is now optional as the graphical display unit 250 can be used to display the signal aspects as well as the supplemental information such as the profile of the upcoming portion of railway track, the estimated distance required to brake the train and the territorial coverage of the railway operating authority. The graphical display unit 250 can also still be used in lieu of the conventional cab display unit. In addition, no acknowledgment input is needed as the automatic train protection function of the invention obviates the conventional prior art uses of the acknowledgment input (i.e., preventing a penalty brake application).

Regarding the cab signal filter/decoder device 310, well known techniques could be used to decode the electrical cab signals received from the wayside signal devices. The signal aspect information communicated from the filter/decoder device 310 to the rail navigation system 200 could be conveyed in the form of discrete inputs relating to each signal aspect so that no intelligence or processing capability is required in the filter/decoder device 310. Alternatively, the cab signal filter/decoder device 310 may include a microcontroller with the signal aspect information being communicated over a serial data interface to the rail navigation system 200.

The presently preferred embodiment for carrying out the invention has been set forth in detail according to the Patent Act. Those persons of ordinary skill in the art to which this invention pertains may nevertheless recognize various alternative ways of practicing the invention without departing from the spirit and scope of the appended claims. Those of such skill will also recognize that the foregoing description and drawings are merely illustrative and not intended to limit any of the ensuing claims to any particular narrow interpretation.

Accordingly, to promote the progress of science and the useful arts, I secure for myself by Letters Patent exclusive rights to all subject matter embraced by the following claims for the time prescribed by the Patent Act.

I claim:

1. An integrated cab signal and rail navigation system for a rail vehicle travelling along a railway track featuring a multiplicity of wayside signal devices each of which situated along such railway track so as to communicate from a railway operating authority information including directions as to how such rail vehicle should proceed along a segment of such railway track generally corresponding thereto, said integrated system comprising:

(a) a cab signal system to which said information is communicated from each of such wayside signal devices as such rail vehicle approaches thereto; and (b) a rail navigation system, to which said cab signal system is connected, for determining whether such segment that such rail vehicle is encountering is covered by one of such wayside signal devices and thus whether and how brakes of such rail vehicle will be operated thereon whether said rail navigation system receives or fails to receive said information while such rail vehicle is encountering such segment of such railway track.

2. The integrated cab signal and rail navigation system recited in claim 1 wherein said rail navigation system includes:

(a) a storage device for storing a database including data pertaining to (i) locations of railway track routes, (ii) locations and orientations of curves and switches in each of such railway track routes, and (iii) location of such segments of such railway track routes covered by such wayside signal devices;

(b) a speed sensing device for sensing rotation of a wheel of such rail vehicle for generating a first signal from which at least one of speed of and distance traveled by such rail vehicle can be determined;

(c) a rate of turn measuring apparatus for measuring a rate at which such rail vehicle turns while traveling on a curve of such railway track for generating a second signal from which curvature of such railway track can be determined;

(d) a navigational receiver for receiving positional coordinates that such rail vehicle occupies and for generating a third signal indicative of an approximate position of such rail vehicle on such railway track; and (e) a computer, according to instructions contained within programming code, for using said signals along with and in comparison to said data to determine whether said information should be available from such segment that such rail vehicle is encountering and thus whether and how such brakes of such rail vehicle will be operated thereon should a rail vehicle operator be required and fail to operate such brakes according to at least one braking profile calculated by said computer.

3. The integrated cab signal and rail navigation system recited in claim 2 wherein said computer continuously updates said at least one braking profile based on a variety of parameters including said data, said signals, and said information from such segment from which such rail vehicle last obtained said information.

4. The integrated cab signal and rail navigation system recited in claim 2 further including an aspect display unit for displaying aspect indications contained within said directions.

5. The integrated cab signal and rail navigation system recited in claim 4 further including a means for acknowledging a more restrictive of said aspect indications.

6. The integrated cab signal and rail navigation system recited in claim 2 further including a means for imposing a penalty brake application should such rail vehicle run afoul of a speed distance braking profile calculated by said computer.

7. The integrated cab signal and rail navigation system recited in claim 2 further including a graphical display unit for displaying supplemental information.

8. The integrated cab signal and rail navigation system recited in claim 1 wherein such wayside signal device communicates with such rail vehicle via such railway track, said cab signal system including:

(a) a means for picking-up electrical signals from such railway track;

(b) a means for filtering out extraneous noise from said electrical signals thereby passing said information; and (c) a means for decoding said information contained in said electrical signals prior to passage of said information as decoded to said rail navigation system.

9. The integrated cab signal and rail navigation system recited in claim 8 wherein said means for filtering passes said information when said electrical signals exhibit a frequency within a preset frequency band, a magnitude above a prespecified level and a coding rate within predefined tolerances.

10. The integrated cab signal and rail navigation system recited in claim 8 wherein said cab signal system further includes a speed sensing device for sensing rotation of a wheel of such rail vehicle through which to generate a first signal from which at least one of speed of and distance traveled by such rail vehicle can be determined.

11. The integrated cab signal and rail navigation system recited in claim 1 further including an aspect display unit for displaying aspect indications contained within said directions.

12. The integrated cab signal and rail navigation system recited in claim 11 further including a means for acknowledging a more restrictive of said aspect indications.

13. The integrated cab signal and rail navigation system recited in claim 1 further including a means for imposing a penalty brake application should such rail vehicle run afoul of a speed distance braking profile calculated by said rail navigation system.

14. The integrated cab signal and rail navigation system recited in claim 1 further including a graphical display unit for displaying supplemental information.

15. An integrated cab signal and rail navigation system for a rail vehicle travelling along a railway track featuring any one of a continuous and a noncontinuous wayside signaling system through which a railway operating authority communicates from each wayside signal device of such wayside signaling system aspect information as to how such rail vehicle should proceed along a segment of such railway track generally corresponding to one of such wayside signal devices, said integrated system comprising:

(a) a cab signal system to which said aspect information is communicated from each such wayside signal device as such rail vehicle approaches thereto; and (b) a rail navigation system, to which said cab signal system is connected, for assuring operation of brakes of such rail vehicle in compliance with such wayside signaling system whether any particular one of such segments that such rail vehicle is currently encountering is covered by one of such wayside signal devices and whether said rail navigation system receives or fails to receive said aspect information from such particular segment.

16. The integrated cab signal and rail navigation system recited in claim 15 wherein said rail navigation system includes:

(a) a storage device for storing a database including data pertaining to (i) locations of railway track routes, (ii) locations and orientations of curves and switches in each of such railway track routes, and (iii) location of such segments of such railway track routes covered by such wayside signal devices;

(b) a speed sensing device for sensing rotation of a wheel of such rail vehicle for generating a first signal from which at least one of speed of and distance traveled by such rail vehicle can be determined;

(c) a rate of turn measuring apparatus for measuring a rate at which such rail vehicle turns while traveling on a curve of such railway track for generating a second signal from which curvature of such railway track can be determined;

(d) a navigational receiver for receiving positional coordinates that such rail vehicle occupies and for generating a third signal indicative of an approximate position of such rail vehicle about such railway track; and (e) a computer, according to instructions contained within programming code, for using said signals along with and in comparison to said data to determine whether said aspect information should be available from such segment that such rail vehicle is encountering and thus whether and how such brakes of such rail vehicle will be operated thereon should a rail vehicle operator be required and fail to operate such brakes according to at least one braking profile calculated by said computer.

17. The integrated cab signal and rail navigation system recited in claim 16 wherein said computer continuously updates said at least one braking profile based on a variety of parameters including said data, said signals, and said information from such segment from which such rail vehicle last obtained said information.

18. The integrated cab signal and rail navigation system recited in claim 16 wherein said computer uses at least said first signal from said speed sensing device to provide overspeed protection for such rail vehicle should speed of such rail vehicle exceed a predetermined value.

19. The integrated cab signal and rail navigation system recited in claim 15 wherein each of such wayside signal devices communicates with such rail vehicle via such railway track, said cab signal system including:

(a) a means for picking-up electrical signals from such railway track;

(b) a means for filtering out extraneous noise from said electrical signals thereby passing said aspect information; and (c) a means for decoding said aspect information contained in said electrical signals prior to passage of said aspect information as decoded to said rail navigation system.

20. The integrated cab signal and rail navigation system recited in claim 19 wherein said means for filtering passes said information when said electrical signals exhibit a frequency within a preset frequency band, a magnitude above a prespecified level and a coding rate within predefined tolerances.

21. The integrated cab signal and rail navigation system recited in claim 19 wherein said cab signal system further includes a speed sensing device for sensing rotation of a wheel of such rail vehicle through which to generate a first signal from which at least one of speed of and distance traveled by such rail vehicle can be determined.

22. The integrated cab signal and rail navigation system recited in claim 21 wherein said cab signal system further includes a penalty brake control line through which to communicate to said rail navigation system whether a penalty brake application is needed so that said rail navigation system imposes said penalty brake application based on factors including an estimated distance for braking and specific block lengths relative to a current location and a speed of such rail vehicle.

23. The integrated cab signal and rail navigation system recited in claim 15 further including an aspect display unit for displaying said aspect information.

24. The integrated cab signal and rail navigation system recited in claim 23 further including a means for acknowledging a more restrictive of said aspect information.

25. The integrated cab signal and rail navigation system recited in claim 15 further including a means for imposing a penalty brake application should such rail vehicle run afoul of a speed distance braking profile calculated by said rail navigation system.

26. The integrated cab signal and rail navigation system recited in claim 15 further including a graphical display unit for displaying supplemental information.

27. The integrated cab signal and rail navigation system recited in claim 15 wherein said rail navigation system features overspeed protection for such rail vehicle.

28. An integrated cab signal and rail navigation system for a rail vehicle travelling along a railway track featuring any one of a continuous and a noncontinuous wayside signaling system through which a railway operating authority communicates from each wayside signal device of such wayside signaling system aspect information as to how such rail vehicle should proceed along a segment of such railway track generally corresponding to one of such wayside signal devices, said integrated system comprising:

(a) a cab signal system for receiving said aspect information communicated from each such wayside signal device as such rail vehicle approaches thereto and for determining whether a penalty brake application is needed; and (b) a rail navigation system, connected to said cab signal system, for determining whether such segment that such rail vehicle is encountering is covered by one of such wayside signal devices and thus whether and how brakes of such rail vehicle will be operated thereon whether said rail navigation system receives or fails to receive said information while such rail vehicle is encountering such segment of such railway track and for imposing said penalty brake application based on factors including an estimated distance for braking and specific block lengths relative to a current location and a speed of such rail vehicle.

* * * * *